US005683087A

United States Patent [19]

Henshaw et al.

[11] Patent Number: 5,683,087

[45] Date of Patent: Nov. 4, 1997

[54] APPARATUS AND METHOD FOR PLAYING A GAME

[76] Inventors: John Thomas Henshaw; Janice Edna Henshaw, both of 16 Conjola Crescent, Leumeah, New South Wales, Australia, 2560

[21] Appl. No.: 614,857

[22] Filed: Mar. 12, 1996

[51] Int. Cl.[6] ..... A63F 3/00

[52] U.S. Cl. ..... 273/237; 273/256; 273/243; 273/430; 273/276

[58] Field of Search ..... 273/276, 256, 273/237, 238, 243, 288, 290, 430

[56] References Cited

U.S. PATENT DOCUMENTS

| | | | |
|---|---|---|---|
| 2,506,184 | 5/1950 | Twining | 273/276 |
| 4,417,732 | 11/1983 | Guill | 273/238 |
| 5,080,369 | 1/1992 | Mongno | 273/243 |

FOREIGN PATENT DOCUMENTS

| | | | |
|---|---|---|---|
| 2582952 | 12/1986 | France | 273/276 |
| 611043 | 6/1946 | United Kingdom | 273/256 |
| 619432 | 3/1949 | United Kingdom | 273/276 |

OTHER PUBLICATIONS

"Roll–A–Home", Playthings Magazine, Feb. 1960, p. 179.

*Primary Examiner*—Benjamin H. Layno
*Attorney, Agent, or Firm*—Jacobson & Johnson

[57] ABSTRACT

There is an apparatus for playing a game which comprises a game board having sequentially marked spaces along which a plurality of game pieces may be moved. At least some of the spaces correspond to stations where a player may purchase game building components or notional building services to assemble a miniature structure. The apparatus further including building components including miniature ground slab (8), walls (9, 10), ceiling (11), roof (12) and chimney components (13) which interfit in a predetermined manner with at least one of said components incorporating a power supply (17) and light element (18) which upon completion of said structure lights up said structure to identify a winning player.

6 Claims, 3 Drawing Sheets

APPARATUS AND METHOD FOR PLAYING A GAME

This invention relates to games and more particularly it discloses an apparatus and method for playing a game.

BACKGROUND OF THE INVENTION

It is an object of this invention to provide a novel apparatus and method for playing a game which appeals to a wide range of age groups and which may also be of some educational benefit to younger players.

SUMMARY OF THE INVENTION

In one broad form the invention discloses an apparatus for playing a game comprising a playing board having represented thereon one or more pathways composed of sequentially marked spaces along which a plurality of game pieces may be moved according to the throw of a die or operation of other device of chance, at least some of said spaces corresponding to stations where a player may purchase building compononts or notional building services necessary to assemble a miniature model structure and may also earn additional game currency to subsequently purchase further necessary components or services by answering quiz questions or performing specified tasks and said apparatus further comprising said building components which include ground slab, walls, ceiling and chimney components which interfit in a predetermined fashion with at least one of said components incorporating a self contained power supply and light element which upon completion of said model structure lights up said structure to identify a winner of said game.

In another aspect this invention also discloses a method of playing a game using the aforementioned apparatus, said method including the steps of:

- each player in turn moving a game piece a distance along said one or ore pathways in accordance with the throw of a die or other device of chance;
- in the event of landing on a space where building materials or services are available, electing whether or not to purchase said materials or services; and
- assembling said miniature structure using building components and services which have been purchased as said game piece is moved along said one or more pathways.

Preferably said playing board also includes a plurality of areas where each of said players may assemble said model structure.

It is also preferred that at least some of said spaces correspond to stations where a player does not have the opportunity to purchase said materials or services but must perform a task or accept directions as indicated on a selected one of a set of cards.

It is further preferred that at least one of said materials or building components include a means for illuminating said model structure or otherwise indicating the completion thereof to the other players.

BRIEF DESCRIPTION OF THE DRAWINGS

The currently preferred form of this invention will now be described with reference to the attached drawings in which.

In addition the Appendix included as part of this description shows examples of quiz questions and categories therefor, cop-out cards, bankers construction planner, players check list and titles of songs, books and films for use in the game.

DETAILED DESCRIPTION OF PREFERRED EMBODIMENT

Figure 1:
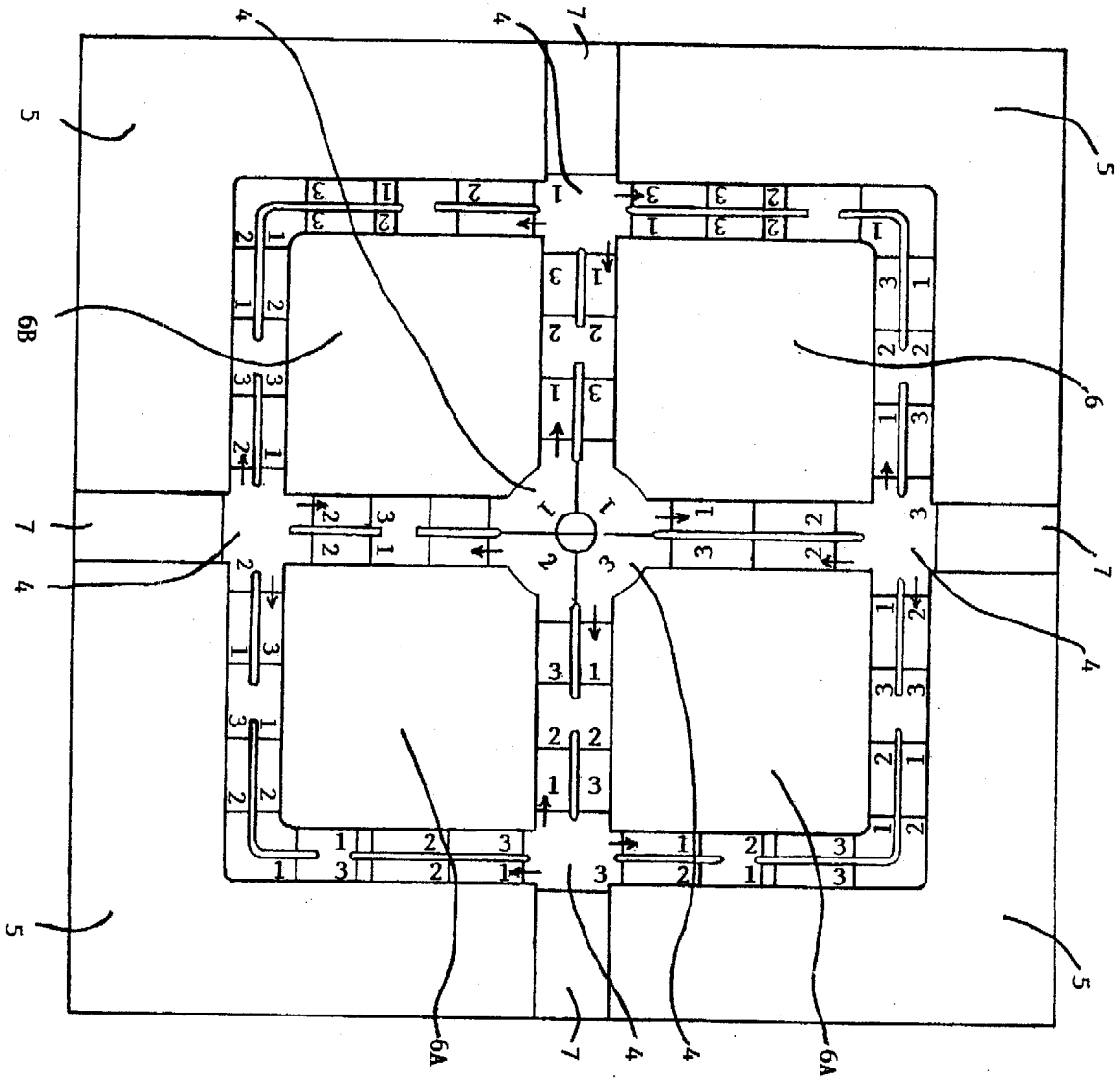
FIG. 1 is a schematic plan view of one form of playing board according to this concept.

Referring first to FIG. 1 the playing board may comprise a series of closed pathways or roads which are divided into parallel rows of spaces marked in repeating sequences of 1 to 3. At the end of each sequence there is a break in the median strip dividing the parallel rows and at the intersection of the various roads and other selected pieces Cop-Out stations 4 are provided. The spaces between the Cop-Out stations are indentified as the locations of suppliers of either a building material or component (e.g. bricks, roofing materials, fit out materials, concrete etc.) or a notional building service (e.g. plumber, carpenter, bricklayer, excavator, painter, floor tiler etc). At each corner of the board a building block 5 may be provided for each of four players to assemble a miniature model of a suburban house as described in ore detail later. There is also a space 6 for the Council Chambers or City Hall. Preferably the board may also be embellished with additional graphics showing the usual amenities of suburbia such as parks 6A and local hospital 6B however these have been omitted from the drawing for simplicity of illustration.

The object of the game is for a player with an initial loan of say $70,000.00 in game money from the game bank to purchase one of the building blocks 5 and then travel around the board to purchase with the balance of the loan funds and any subsequent earnings the necessary building materials or components and services needed to complete his model house. The first player to repay the bank and complete the house by illuminating it wins the game.

Figure 2:
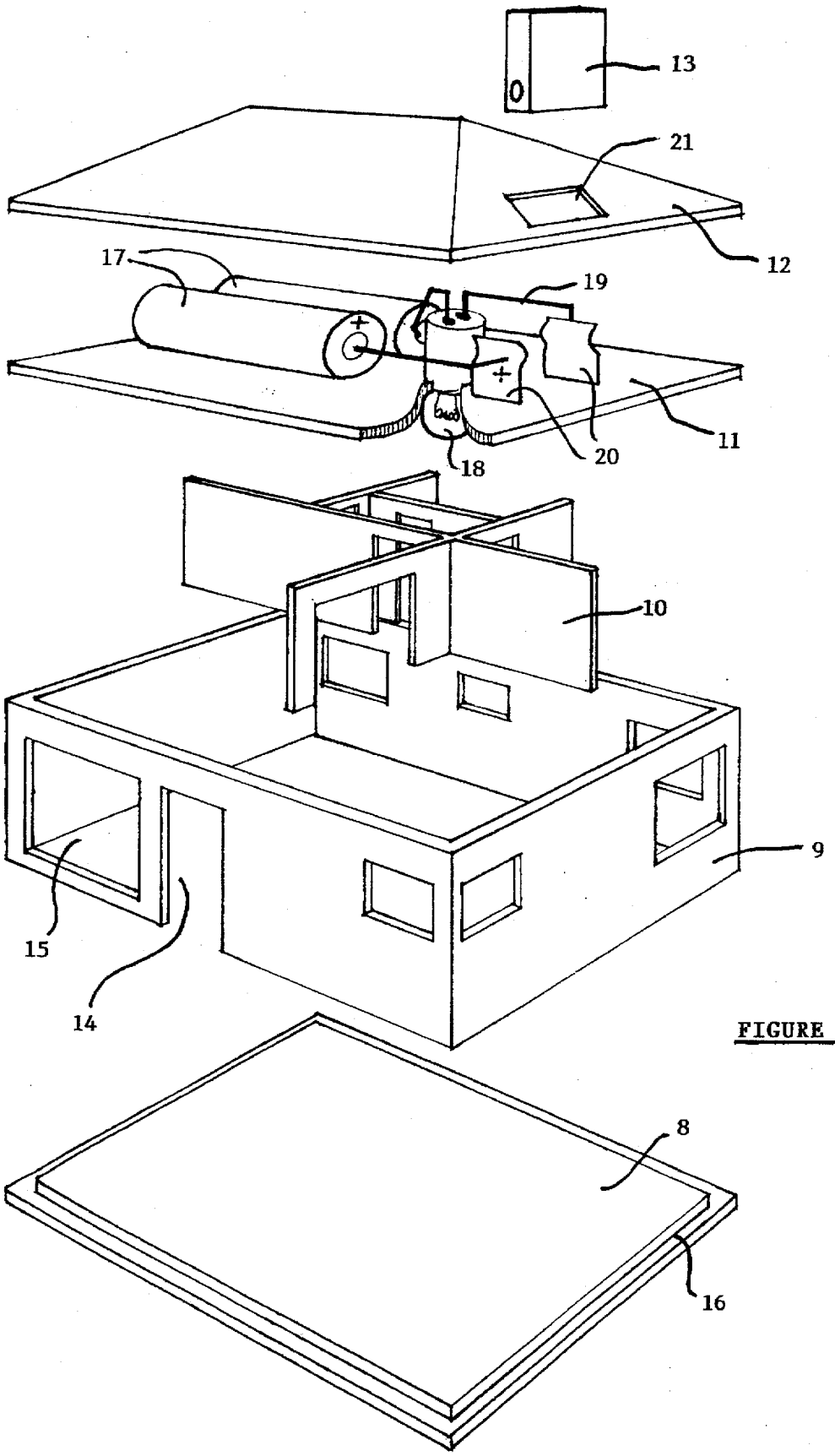
FIG. 2 is an exploded perspective view showing the various components for the model structure.

After each player purchases his building block for say $40,000.00 the game is commenced at an indicated starting point 7 with each player in turn moving a game piece along the roads according to the throw of a die or operation of other like device of chance. Preferably the game pieces are allowed to move in either direction along the roads but are restricted to one side. With this particular example it may be either the left or right side in accordance with local driving conditions. Preferably no U turns are permitted except at breaks in the median strip dividing the roads and at intersections. It is further preferred that a player's piece can be permitted to overtake another. Reverse movement however is not allowed. Each time a game piece stops at a designated location of a building service or component supplier to the player has the opportunity of purchasing in game cash such service or component he requires for his model house using any reserves of cash he has left from the initial bank loan or money subsequently earned. The components required for each model house are preferably but not essentially as shown in FIG. 2 and may comprise the ground slab 8, exterior walls 9, interior walls 10, electrical ceiling light and power supply 11, roof 12 and chimney 13. As shown the slab 8 may be stepped around its periphery and is dimensioned so that the exterior walls 9 with door and window apertures 14, 15 are a push fit onto said slab with the base of the walls 9 engaging the step 16. The interior walls 10 are also dimensioned to be a push fit into the interior cavity formed by the exterior walls and serve to divide the model house into a basic single story floor plan. Following this the ceiling component 11 may be fitted over the internal walls followed by the roof 12. In accordance with the embodiment shown in FIG. 2 the ceiling 11 may include a power supply such as a set of dry cell batteries 17 together with a miniature light bulb 18, electrical wires 19 and switch contacts 20. The chimney 13 when inserted through an aperture 21 in the roof closes the circuit contacts 20 to the bulb 18 and causes it to light up to indicate the winner's completed house.

Figure 4:
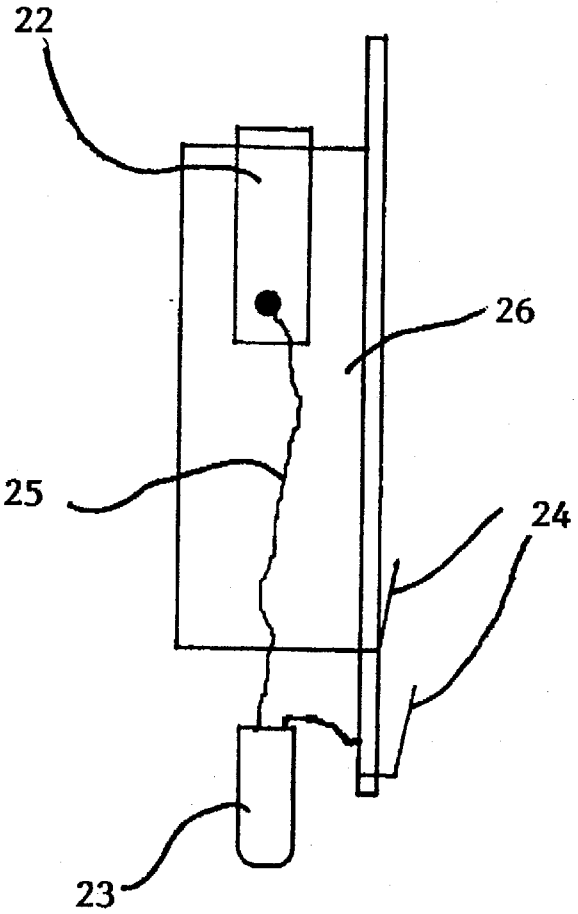
FIGS. 3 and 4 show a variation of some of the building components of FIG. 2.
Figure 3:
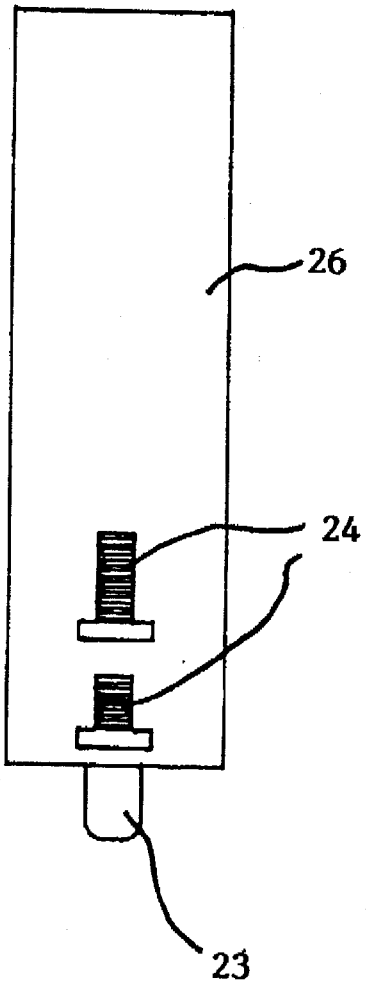

In accordance with a second embodiment shown in FIGS. 3 and 4 the battery power supply 22, a light emitting diode 23, contact points 24 and associated wiring 25 may all be incorporated within the chimney component 24. Insertion of the chimney into the roof aperture of an otherwise completed house operates to close the contact points and illuminate the interior of the house with the LED 23.

Preferably the aforementioned model house components would be made from any suitable form of plastic using known moulding technology. The invention however extends to the use of other materials such as wood or cardboard etc.

In order to earn game money to repay the initial bank loan or purchase building components or services each player has the option at each stop (other than a Cop-Out space) of answering a quiz question such as for example those listed in the Appendix. The invention however is not limited to any specific type of question or subject matter. The cash earned for a correct answer may be for example $5,000.00 or $10,000.00 in game money and may be used either to repay the initial loan or to subsequently pay for more building services or components to complete the model house.

In the event that a player declines to answer a quiz question or lands on a Cop-Out space then said player must accept the directions indicated on a Cop-Out card in accordance whether he has stopped on a space numbered 1, 2 or 3. Non-limiting examples of such directions are shown on the specimen Cop-Out cards in the Appendix. They may include for example a twist of fate, impersonation of a known person, a gamble or a charade. In the latter case the charade rules may be as summarised in the booklet entitled "the Games Treasury" by Merilyn Simonds Mohr and published by Chapters Publishing Ltd.

In the event that a player does not require the materials or services available at a space on which he lands he preferably has the option of selling these at a profit to another player and retaining said profit. Preferably however it is not permissible to corner the market by purchasing building materials or services surplus to a player's requirements.

Preferably each player keeps a check list to record the components and services purchased and this must accord with a construction planner kept by the bank. Examples of such records are shown in the Appendix.

The winner is the first player to finish his model house and complete the following steps:

repay the initial loan, stop at the council chambers or city hall, purchase the chimney, and insert the chimney to illuminate the house.

Subsequent places are determined by the remaining players playing out the game or counting their money and the cash value of building components and services purchased.

The game is preferably but not exclusively played with four players or teams of players together with a game master to monitor the rules and ask quiz questions etc. A non-player banker may also be included to handle the game money and keep the construction planner for each player.

It will thus be appreciated that this invention at least in the form of the embodiments described provides a novel and entertaining game for players of various ages. Clearly however the example disclosed is only the currently preferred form of this concept and a wide variety of modifications may be made which would be apparent to a person skilled in the art. For example the layout of the playing board and the number and placement of the various locations for services and building components as well as the Cop-Out spaces may all be varied according to design preference. The invention is further not limited to any particular shape or configuration for the model structure or the building components from which they are assembled. The game apparatus and rules may further be modified to suit any number of players as required.

APPENDIX

EXAMPLES OF CATEGORIES FOR QUIZ QUESTIONS

1. Places
2. Animals
3. Music
4. Movies & Television
5. Australian History
6. Famous Quotes
7. Sport
8. Crosswords
9. Crimes/The Law
10. Transport
11. Australian Politics
12. Books/Art
13. Food and Drink
14. Proverbs
15. The Universe
16. Fun with Maths
17. Our Bodies
18. What's in a Name!
19. Architecture
20. Travel
21. Computers
22. Spelling
23. Anagrams and Cryptics
24. Religion
25. Explorers
26. The Olympics
27. Miscellaneous
28. What is a . . . !

EXAMPLES OF QUIZ QUESTIONS

Famous Quotations

Difficult Questions

1. Which controversial female pop star said—'Crucifixes are sexy because they've got a naked man on the front'! MADONNA 2. Which former Wimbeldon tennis champion made the following ironic statement—'It is vital, in my opinion, that tennis maintains a strong and watchful stand against swearing'! JOHN McENROE 3. Who said—'If I treat my body properly, I believe I'll live to 150', Elle McPherson or Michael Jackson! MICHAEL JACKSON Easier Questions 1. Which famous American comedian, first name Mel, said 'If Presidents don't do it to their wives, they do it to the country'! MEL BROOKS 2. Which Nazi leader said 'The Americans ought to be ashamed of themselves for letting their medals be won by Negroes'! ADOLF HITLER 3. Who said—'I married a German. Every night I dress up as Poland and he invades me'—Bette Midler or Eva Braun! BETTE MIDLER

EXAMPLES OF COP-OUT CARDS

1. A TWIST OF FATE: Four numbers and a supplementary in Lotto scores you $10,000 Collect from bank.

2. COMPLETE THE CHORUS: If you can successfully sing the chorus lines of the song, (neither the ability to keep a note nor the quality of the voice—or even the exact words—are important; the applause of the majority of other players is the test) then you receive $8000. If you choose to recite the words instead of singing them, then you receive $3000 only.

CLUE: "So whistle a happy tune, hold your head erect . . . "

3. TRY YOUR LUCK: Throw the dice . . . if you score a double, take your vehicle to the space of your choice and if you wish make a purchase . . . no brainteaser however.

1. A TWIST OF FATE: Council inspection condemns fitout work in bath. Pay $5000.

2. IMPERSONATION: Impersonate a famous person, an actor, a singer, a politician or a friend. In 30 seconds you must secretly write down the name of your selection on a piece of paper, place it face down on the table (for later checking) and announce the category of your selection (but not the name) to the other players. By means of acting, speaking, singing or mime, and the use of props (if any) of your choice, you have a further 30 seconds to enable one of the other players to recognise your selection. If successful you receive $8000, the successful player receives $3000.

3. TRY YOUR LUCK: throw the both dice three times . . . collect $2000 for 1 pair, $5000 for 2 pairs and a jackpot of $20,000 for 3 pairs.

1. A TWIST OF FATE: Miss a turn if you get your next BRAIN TEASER wrong

2. CHARADE THE TITLE OF A SONG. In 30 seconds you must secretly write down the name of your selection on a piece of paper and (for later checking) place it face down on the table. By means of acting, mime and the recognised charade signals (feel free to help players who do not know these signals) you have a further 30 second to enable one of the other players to recognise your selection. If successful you receive $8000, the successful player receives $3000.

3. TRY YOUR LUCK: Close your eyes immediately . . . if you can correctly guess how many shoes (not including thongs or sandals) there are in the room collect $8000.

BANKER'S CONSTRUCTION PLANNER

| | | ITEM | | | BANKER TO TICK WHEN PLAYER PAYS FOR ITEM | | | |
|---|---|---|---|---|---|---|---|---|
| | STAGE OF | | | | PLAYER 1 | PLAYER 2 | PLAYER 3 | PLAYER 4 |
| STAGE | CONSTRUCTION | MATERIAL | SUBCONTRACTOR | PRICE | (Name) | (Name) | (Name) | (Name) |
| 1 | CONCRETE SLAB | | EXCAVATOR | $2,000 | | | | |
| | | | CONCRETOR | $4,000 | | | | |
| | | CONCRETE | | $14,000 | | | | |
| 2 | WALLS | BRICKS | | $10,000 | | | | |
| | | | BRICKLAYER | $10,000 | | | | |
| 3 | INTERNAL FITOUT | | PLUMBER | $4,000 | | | | |
| | | | CARPENTER | $5,000 | | | | |
| | | | ELECTRICIAN | $4,000 | | | | |
| | | | FLOOR TILER | $3,000 | | | | |
| | | | PAINTER | $4,000 | | | | |
| | | FITOUT MATERIALS | | $25,000 | | | | |
| 4 | ROOF | ROOF MATERIALS | | $15,000 | | | | |
| | | | ROOFTILER | $5,000 | | | | |
| 5 | | REPAYMENT BANK LOAN | | $70,000 | | | | |
| 6 | | COUNCIL INSPECTION & SOLAR ROOF BATTERY | | $5,000 | | | | |

PLAYERS CHECK LIST

| | | TEAM | | | |
|---|---|---|---|---|---|
| ITEM | PRICE | 1 Leader | 2 Leader | 3 Leader | 4 Leader |
| Concrete (Slabs) | $14,000 | | | | |
| Excavator | $2,000 | | | | |
| Concretor | $4,000 | | | | |
| Bricks (Walls) | $10,000 | | | | |
| Bricklayer | $10,000 | | | | |
| Fitout Materials (Partitions) | $25,000 | | | | |
| Plumber | $4,000 | | | | |
| Carpenter | $5,000 | | | | |
| Electrician | $4,000 | | | | |
| Floor Tiler | $3,000 | | | | |
| Painter | $4,000 | | | | |
| Roof Materials (Roof) | $15,000 | | | | |
| Roof Tiler | $5,000 | | | | |
| Bank Loan | $70,000 | | | | |
| Council Inspection & Solar Roof Battery | $5,000 | | | | |

We claim:

1. An apparatus for playing a game comprising a playing board having represented thereon one or more pathways composed of sequentially marked spaces along which a plurality of game pieces may be moved according to the throw of a die or operation of another device of chance, a plurality of game currency, a plurality of game building components including miniature ground slab, walls, ceiling, roof and chimney which interfit in a predetermined manner to form a miniature structure, a first plurality of said spaces corresponding to stations where a player may purchase said game building components or notational building services to assemble said miniature structure, a means for providing quiz questions, a means for providing specific tasks which players must perform, a second plurality of spaces corresponding to stations where a player may also earn additional game currency to subsequently purchase further necessary building components or services by answering quiz questions or performing specified tasks and with at least one of said components incorporating a power supply and light element wherein at least another one of said components representing a final component which upon the placement of final component on said miniature structure to complete said structure closes the circuit between the power supply and light element, lighting up said structure to identify a winning player of said game.

2. The apparatus as claimed in claim 1 wherein said exterior walls are dimensioned to be a push fit over stepped edge portions of said slab.

3. The apparatus as claimed in claim 2 wherein said power supply comprises one or more batteries which are located between the ceiling and roof and are wired through a switch to a light bulb in said ceiling whereby insertion of the chimney through an aperture in said roof upon completion of said model structure illuminates the interior of said structure.

4. The apparatus as claimed in claim 3 wherein a battery power supply, light emitting diode and a pair of switch contacts are incorporated into said chimney, said light emitting diode being wired to said power supply through said pair of switch contacts which are located on the outside of said chimney whereby insertion of said chimney through an aperture in the roof causes said switch contacts to close and the light emitting diode to illuminate the interior of said structure.

5. A method of playing a game using the apparatus as claimed in claim 1, said method including the steps of:

each player of the game in turn moving a game piece a distance along said one or more pathways in accordance with the throw of a die or other device of chance, in the vent of landing on one of said spaces where a game building component or service is available, electing whether or not to purchase said component or service, and assembling said miniature structure using building components and services which have been purchased as said game piece is moved along said one or more pathways.

6. The method as claimed in claim 5 and including the additional step of electing whether or not to attempt to answer a quiz question after landing on said one of said spaces to earn additional game currency.

* * * * *